US006047946A

United States Patent [19]

Kolanus

[11] Patent Number: 6,047,946

[45] Date of Patent: Apr. 11, 2000

[54] BLOCKING STRUCTURE FOR PREVENTING ACTUATION OF A VALVE FOR PRESSURIZED CONTAINERS

[75] Inventor: Guenter Kolanus, Niedernhausen, Germany

[73] Assignee: Precision Valve Corporation, Yonkers, N.Y.

[21] Appl. No.: 09/031,576

[22] Filed: Feb. 27, 1998

[51] Int. Cl.[7] ..... B65D 83/56

[52] U.S. Cl. ..... 251/89; 222/402.11

[58] Field of Search ..... 251/89; 222/402.11, 222/153.13, 153.11, 153.14

[56] References Cited

U.S. PATENT DOCUMENTS 3,186,605 6/1965 Potoczky ..... 251/89 X 3,503,543 3/1970 Prussin et al. ..... 251/89 X 5,038,964 8/1991 Bouix ..... 222/402.11 X

*Primary Examiner*—Kevin Lee

*Attorney, Agent, or Firm*—Kilgannon & Steidl

[57] ABSTRACT

The aerosol valve of this invention comprises a unitary valve housing, a valve stem disposed in said housing having a lower portion with a recess for a gasket, which gasket seals against the interior of the lower portion of the housing to form a valve blocking chamber, the valve stem further having a recess in its base for receiving an incompressible, free-falling object when the valve is in a predetermined orientation that permits actuation on opening of the valve, the gasket on the lower portion of the valve stem being integrally formed with the recess of the valve stem.

9 Claims, 2 Drawing Sheets

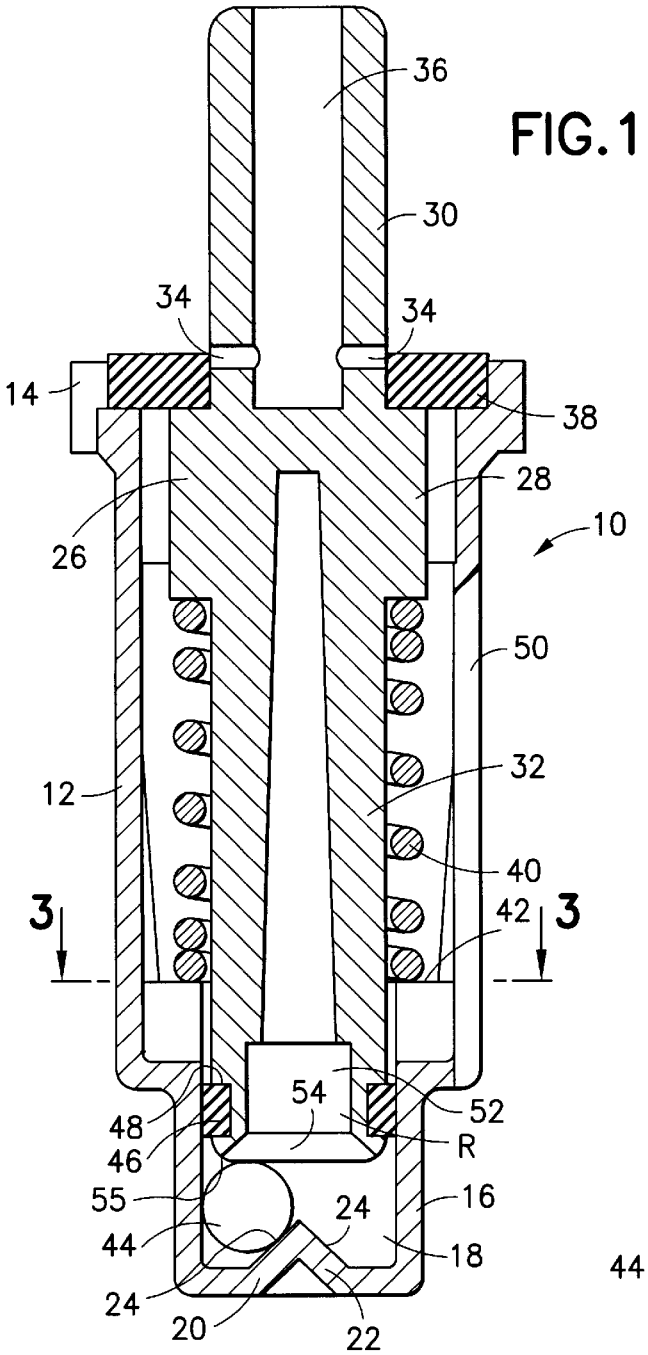
FIG. 1
FIG. 3
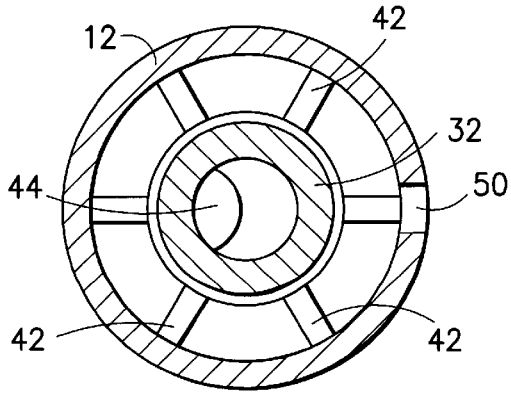

BLOCKING STRUCTURE FOR PREVENTING ACTUATION OF A VALVE FOR PRESSURIZED CONTAINERS

This invention relates to a valve for a pressurized container, more specifically, an aerosol container.

BACKGROUND OF THE INVENTION

A pressurized container usually contains a product together with a propellant. The propellant usually creates the necessary pressure inside the container. The propellant may be a liquid or a gaseous propellant. When the propellant is a liquid propellant, the pressure inside the container is created by the vapor pressure of the liquid propellant. The gaseous propellant and the vapor phase of the liquid propellant are usually located in the headspace of the container when the container stands in its upright position. The pressure inside the container is higher than the normal outside atmospheric pressure. The inside pressure of the container is maintained by closing the container with a valve. Consequently, the propellant tends to exit from the inside of the container once the valve of the container is opened. Thereby, the propellant also drives the product out of the container.

In order that all of the product can be expelled out of the container it has to be ensured that enough propellant is available in the container with respect to the amount of product. Consequently, it has to be ensured that the propellant is not allowed to exit unnecessarily, i.e. the product must be expelled at the same time as the propellant. If product is not expelled at the same time as the propellant, the propellant may be progressively emptied out of the pressurized container until the remaining amount of propellant may become too low with respect to the rest of product remaining in the container to ensure the complete dispensing of the rest of product from inside the pressurized container. The rest of the product which cannot be expelled from inside the pressurized container is then wasted. Other possible drawbacks of propellant exiting unnecessarily from the container are deterioration of the characteristics of the expelled product. For example, when the product is a foaming product, the density of the foam may increase in an undesirable manner.

The discharge of propellant without product may happen whenever the product is not placed between the propellant and the discharge orifice of the pressurized container. Indeed, it has to be ensured that the propellant is obliged to pass through the product, pushing at least part of the product out of the pressurized container. This undesirable positioning of the propellant with respect to the product and the discharge orifice of the pressurized container may be reached when the pressurized container is allowed to discharge while the container is rotated from the desired discharge position.

For example, when the pressurized container comprises a dip tube connecting the discharge orifice at the top of the container with the inside of the pressurized container, the undesired direction would be to invert the pressurized container, i.e. to turn it upside down. In this position the gaseous propellant in the headspace is capable of escaping directly from the inside of the container through the dip tube without pushing the product through the dip tube. By contrast, when the pressurized container does not include a dip tube, the undesired direction would be when the container is not inverted, i.e. the container is held upright. This substantially upright position leads to the escape of gaseous propellant from the inside of the container, because the product is not positioned between the discharging opening and the propellant. In both cases this leads to the escape of propellant from the inside of the container without any corresponding expulsion of product, resulting in the corresponding drawbacks as discussed above.

It is well known in the industry making pressurized containers that there is a need to provide the pressurized containers with a blocking mechanism which prevents the opening of the pressurized container when the pressurized container is in an undesired orientation. WO-91/03 408 and WO-95/06 606 describe blocking mechanisms, e.g., in form of a ball, located inside the pressurized container so as to block the discharge orifice of the pressurized container when the pressurized container is in an undesired orientation. In the prior art, the blocking mechanism is in direct contact with the product and the propellant during the discharging flow when the valve of the pressurized container is opened.

It has been found that the blocking mechanism positioned in this way in the discharging flow only works for low discharging rates of about 2 grams of product per second as the maximum limit. Indeed, the discharging rate has to be low enough such that the blocking means, e.g. the ball, is not dragged in the product and/or propellant flow. Otherwise the blocking means may be pushed by the discharging product and/or propellant into the blocking position of the valve even when the valve is oriented in the correct position. Therefore, it would be preferable to have a blocking mechanism separated from the discharging flow of the product and/or the propellant.

A blocking mechanism which is separated from the discharging flow of the product and/or of the propellant is, for example, described in U.S. Pat. No. 3,186,605. Thus patent describes a valve comprising a blocking mechanism along a side of a valve stem. The blocking means comprises a circular transverse wall member, a circular plate and a non-compressible ball. The transverse wall member and the circular plate are rigidly connected to each other. The non-compressible ball is placed between the transverse wall member and the circular plate. The circular plate is smaller in diameter than the transverse wall member. To open the valve, the transverse wall member has to slide axially within the valve chamber towards a transverse shelf wall. The valve is free to be opened when the ball remains within the diameter of the circular plate. The valve is blocked when the ball rolls away from the circular plate onto the transverse shelf wall, since the transverse wall member is not prevented by the non-compressible ball from sliding towards the transverse shelf wall.

However this valve is quite bulky, since the overall diameter of the valve is increased by the transverse wall member and the valve chamber with respect to standard valves for standard pressurized containers. Furthermore, the part of the valve comprising the blocking mechanism is located on one side of the valve stem. Consequently, the container needs to have a wider opening to allow the insertion of this valve into the container with respect to usual valves, i.e., the containers in which to insert this valve of '605 have to be specially adapted and made. This increases also the manufacturing costs of a container with this kind of valve.

Another type of blocking mechanism is described in WO-89/10881, FR-A-2 637 870 and EP-A-0 526 298. The blocking mechanism is now located within the nozzle outside the pressurized container. It has been found that having the blocking mechanism in the nozzle limits the form and the dimension of the nozzle itself. Indeed, the nozzle has to be constructed in such a manner that it allows the functioning of the blocking mechanism. Furthermore, it has been found that such a specific nozzle comprising the blocking means has an increased cost with respect to usual nozzles available on the market. This means that when the blocking mechanism is not part of the valve, only specific, usually not cost effective nozzles can be used.

A further type of blocking mechanism is shown in British Pat. No. 1,470,013. As with several mechanisms of the prior art, in the British patent, the product flows through the blocking mechanism.

In pending European Patent Application No. EP-A-0811 563, published on Dec. 10, 1997, there is a valve blocking mechanism described wherein the blocking mechanism preventing the opening of the valve when the discharge orifice of the valve is in an undesired orientation, is separated from the discharging flow of the discharging product and/or propellant from inside the pressurized container when the valve is in an open position, allowing the use of any cost effective nozzle available on the market and having dimensions which allow the application of the valve of said patent application to conventional containers.

In the invention of said European patent application there is a valve comprising a stem, a housing, and a blocking means. The stem is movable within the housing to allow the opening and the closing of the valve. The stem comprises a discharge orifice connected to a discharge conduit. The discharge conduit is located on one end of the stem. The stem is free to move reciprocally within the housing. The blocking mechanism is situated within the housing and acts to block the movement of the stem within the housing when a container bearing the aforedescribed valve is in an undesired position. European Patent Application No. EP-A-0 811 563 is incorporated by reference herein and made a part of the disclosure of this invention.

As noted earlier, an aerosol valve is a multi-component structure that must be molded and assembled. Aerosol valves are also mass-produced items. Any decrease in the number of molding and/or assembly operations affords a considerable economic advantage to the valve manufacturer. It is one object of this invention to mass-produce the blocking valve of this invention in a cost effective manner.

SUMMARY OF THE INVENTION

The aerosol valve of this invention comprises a unitary valve housing, a valve stem disposed in said housing having a lower portion with a recess for a gasket, which gasket seals against the interior of the lower portion of the housing to form a valve blocking chamber, said valve stem further having a recess in its base for receiving an incompressible, free-falling object when the valve is in a predetermined orientation that permits actuation on opening of the valve, said gasket on the lower portion of the valve stem being integrally formed with the recess of the valve stem.

BRIEF DESCRIPTION OF THE DRAWINGS

FIG. 1 is a cross-sectional view of the valve of this invention sans a mounting cup, showing the valve in an upright position.

FIG. 3 is a plan view through the line "3—3" of FIG. 1.

DETAILED DESCRIPTION OF THE INVENTION

Figure 2:
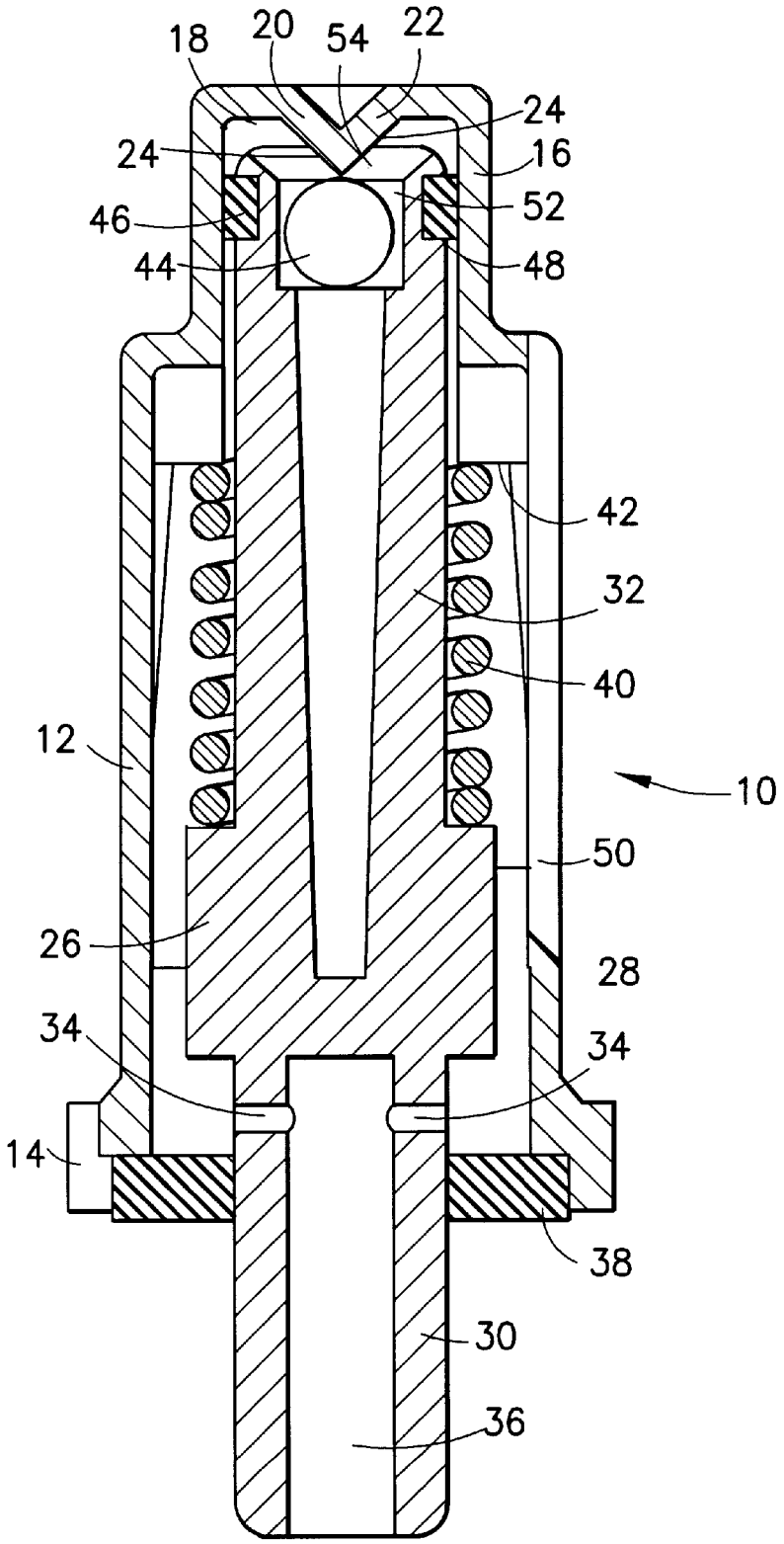
FIG. 2 is the valve of FIG. 1 with the valve shown in an inverted position.

In FIG. 1, the valve of this invention is shown in an upright position and the valve may not be activated to discharge product.

In FIG. 1, the valve, generally designated as 10, has a valve housing 12, the upper end of which has a conduit 14 for rapidly filling the container, not shown, with propellant. The upper end of the housing is more fully described in U.S. Pat. No. 4,015,757. The lower end of the housing 12 has an extended portion 16 which defines a recess 18. The bottom surface 20 of the housing 12 has a raised portion 22 formed by two intersecting sloped portions 24 that traverse the diameter of recess 18. An elongated slot 50 is disposed in the housing 12, which slot is open to the inside of the container (not shown).

A valve stem 26, having a body portion 28, a valve stem orifice portion 30 extending upwardly from the body portion 28, and a lower portion 32 extending downwardly from the body portion 28 is disposed within the perimeter of the housing 12, the body portion 28 and the lower portion 32 being surrounded by the housing 12 and the valve stem orifice portion 30 extending beyond the upper end of the housing 12. The upper portion 30 of the stem 26 has stem orifices 34 leading to a central conduit 36. Located atop the upper portion 30 is a discharge button or actuator (not shown). At the base of the lower portion 32 of the valve stem 26 is a recess 52 terminating at its lower end in a tapered entry portion 54. The depth of the recess 52 is sufficient to receive the steel ball 44. The terminal annular edge 55 of the recess 52 is disposed to be slightly distanced from the steel ball 44 when the valve is in an upright position. Disposed on the valve stem orifice portion 30 of the valve stem 26 and disposed to encircle and seal the stem orifices 34 when the valve 10 is in closed position, is a gasket 38. A spring 40 is disposed between the body portion 28 of the valve stem 26 and an interrupted annular shoulder 42 disposed on the lower end of the stem (see FIG. 3). Disposed in the recess 18 is a steel ball 44. A second or lower gasket 46 is disposed in the annular recess 48 encircling the lower portion 32 of the valve stem 26. The lower portion 32 of the valve stem 26 is dimensioned relative to the inside wall of the extended portion 16 of the housing 12 such that the lower gasket 46 seals off the recess 18 from the interior of the valve housing above the lower gasket 46.

The spacing of the annular edge 55 from the steel ball 44, as shown in FIG. 1, is sufficiently proximate such that a downward thrust of the valve stem 26 will cause the edge 55 to abut the steel ball 44 and prevent further downward movement of the valve stem 26 and consequently preclude the stem orifices 34 from clearing the gasket 38 to permit delivery of product/propellant to the conduit 36 through the elongated slot 50.

The lower gasket 46 is formed in the annular recess 48 by co-injecting the gasket and the valve stem. FIG. 1 illustrates the integrated valve stem 26 and lower gasket 46 locked together as one piece. In molding the integrated valve stem and lower gasket, the valve stem 26 is initially molded as a single piece in a first conventional injection molding operation.

Following the molding of the valve stem 26, the valve stem 26 is moved to a separate molding station whereat it is centered and supported in a mold (not shown), which mold isolates the annular recess 48 to the flow of gasket material in the second mold and, thereby, forms an integrated valve stem 26 and lower gasket 46 in the annular recess 48.

Having an integrated valve stem and lower gasket provides a stability to the stem and gasket which permits the insertion of the valve stem into proper positioning in the lower end of the valve housing without concern about dislodgement of the gasket during seating in the housing or during the repeated reciprocal movement of the lower gasket against the interior wall of the housing during use of the valve unit in an aerosol container.

In the upright position of FIG. 1, the valve cannot be opened. Downward thrust on the valve stem is precluded by the incompressible sphere blocking the advance of the valve stem. When the valve is inverted, as shown in FIG. 2, the incompressible sphere moves by gravity to a position within the recess at the base of the valve stem, and advance of the valve stem by manual force will result in opening the valve. Obviously, when the described valve is affixed to its mounting (mounting cup) and, in turn, the mounting cup positioned in a sealed relationship with the aerosol or pressurized container, product and propellant will be discharged only when the container has been rotated from an upright position to a position wherein the incompressible sphere moves to the recess in the base of the valve stem.

This invention has been described in terms of a valve that is opened only when the valve is rotated sufficiently from an upright position to permit movement of the incompressible sphere from a blocking to a non-blocking position. Correspondingly, this invention may be used in a system such as shown in FIGS. 2*a* and 2*b* of European Patent Application Serial No. EP-A-0 811 563 to provide a system wherein the valve stem is free to move downwardly to open the valve when the valve and its associated container are in an upright position and to be in a blocking position when the valve and its associated container are in an inverted position.

Many possible embodiments may be made without departing from the scope hereof; it is to be understood that all description herein set forth or shown in the accompanying drawings is to be interpreted as illustrative and not in a limiting sense.

What is claimed is:

1. A valve comprising a housing having a side wall with at least one opening, a valve stem having a valve stem orifice portion with a conduit therethrough and at least one valve stem orifice communicating the interior of the housing and the conduit, the valve stem orifice being encircled by a gasket, said valve stem further having a body portion beneath the valve stem orifice portion and a lower stem portion having an outer wall with an annular recess having a lower gasket disposed therein and further having a recess in the base of the lower stem portion, said valve stem being disposed within the housing and having the capability of reciprocal movement relative to the interior of the housing upon the application and withdrawal of manual pressure to the valve stem; the interior of the housing beneath the gasket on the lower stem portion, and the outer wall of the lower stem portion beneath the lower gasket together with the recess in the base of the valve stem defining a valve blocking chamber, which chamber together with an incompressible spherical object located therein forms a valve actuation blocking means when the valve is in a normal upright orientation, said chamber being isolated from the housing opening, characterized in that the lower gasket of the lower valve stem acts to isolate and seal the valve blocking chamber from the interior of the housing outside of the valve blocking chamber, and wherein the groove in the lower valve stem and the gasket disposed in said groove are integrally formed.

2. The valve of claim 1, and further wherein the valve actuation blocking means is so disposed that the valve is precluded from opening when the valve is in an upright position.

3. The valve of claim 1, and further wherein the valve actuation blocking means is so disposed that the valve is precluded from opening when the valve is in an inverted position.

4. The valve of claim 1, and further wherein the housing is a unitary member.

5. The valve of claim 2, and further wherein the housing is a unitary member.

6. The valve of claim 3, and further wherein the housing is a unitary member.

7. The valve of claim 1, and further wherein the valve actuation blocking means comprises an upstanding portion extending within the housing from the bottom of the interior of the housing, an incompressible sphere disposed within the lower portion of the housing and a recess in the base of the valve stem, which recess may receive the sphere when the valve is inverted.

8. The valve of claim 2, and further wherein the valve actuation blocking means comprises an upstanding portion extending within the housing from the bottom of the interior of the housing, an incompressible sphere disposed with the lower portion of the housing and a recess in the base of the valve stem, which recess may receive the sphere when the valve is inverted.

9. The valve of claim 5, and further wherein the valve actuation blocking means comprises an upstanding portion extending within the housing from the bottom of the interior of the housing, an incompressible sphere disposed with the lower portion of the housing and a recess in the base of the valve stem, which recess may receive the sphere when the valve is inverted.

* * * * *